United States Patent [19]

Blaschke et al.

[11] 4,193,462

[45] Mar. 18, 1980

[54] ROTARY BORING HEAD

[75] Inventors: Kurt Blaschke, Saarbrücken-Dudweiler; Josef Roob, St. Wendel, both of Fed. Rep. of Germany

[73] Assignee: Stahl- und Apparatebau Hans Leffer GmbH, Saarbrücken-Dudweiler, Fed. Rep. of Germany

[21] Appl. No.: 882,879

[22] Filed: Mar. 2, 1978

[30] Foreign Application Priority Data

Mar. 2, 1977 [DE] Fed. Rep. of Germany ..... 2709030

[51] Int. Cl.[2] ..... E02D 17/14

[52] U.S. Cl. ..... 175/292; 175/171; 175/394

[58] Field of Search ..... 175/292, 171, 394, 263

[56] References Cited

U.S. PATENT DOCUMENTS

| | | | |
|---|---|---|---|
| 1,779,575 | 10/1930 | Wilson | 175/292 |
| 2,112,228 | 3/1938 | Kandle | 175/292 |
| 2,838,285 | 6/1958 | Gredell | 175/394 |
| 2,990,896 | 7/1961 | Kandle | 175/292 |
| 3,032,128 | 5/1962 | Walton | 175/292 |
| 3,385,383 | 5/1968 | Sturgeon | 175/292 |
| 3,693,734 | 9/1972 | Richmond | 175/292 |
| 3,734,214 | 5/1973 | Benetti | 175/171 |

*Primary Examiner*—William F. Pate, III

*Attorney, Agent, or Firm*—John J. Dennemeyer

[57] ABSTRACT

A rotary boring head for earth and rock formations with pivotal wings which may be swung radially outwardly and which are provided with inclined return rails. Upon upward movement of the rotary boring head the earth mass presses upon the inclined return rails, so that the pivotal wings are reliably swung inwards again and cannot impinge on the bore tube.

3 Claims, 7 Drawing Figures

ROTARY BORING HEAD

Figure 1:
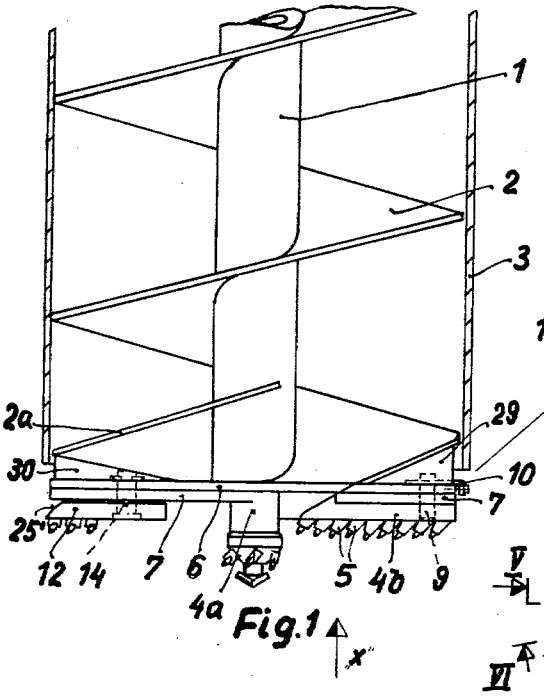

The invention relates to a rotary boring head for earth and rock formations with a rotating double-wing-shaped chisel support fitted with round shaft chisels, and with diametrically disposed pivotal wings which are mounted on shafts parallel to the axis of rotation of the chisel support and which are also fitted with round shaft chisels, the chisels cutting freely when the pivotal wings are in a radially outwardly swung working position in relation to the chisel support which position is limited by an abutment, and the pivotal wings swinging back into an inner rest position upon reversal of the direction of rotation, when the boring head is to be withdrawn from the bore hole. Thus the invention starts from the German Patent Specification No. 2 242 724 which describes a rotary boring head having pivotal wings which are disposed diametrically on a chisel support and which swing radially outwardly during boring operations and increase the bore circle since they are fitted with round shank chisels, just as the chisel support.

According to the present invention there is provided a rotary boring head for earth and rock formations, comprising a rotating double-wing-shaped chisel support, round shaft chisels fitted on said support, diametrically disposed pivotal wings, shafts mounting said pivotal wings parallel to the axis of rotation of the chisel support, round shaft chisels fitted on said pivotal wings, the chisels being capable of cutting freely when the pivotal wings are in a radially outwardly swung working position in relation to the chisel support, an abutment for limiting said movement of the wings, and the pivotal wings being arranged to swing back into an inner rest position upon reversal of the direction of rotation, when the boring head is to be withdrawn from the bore hole, wherein for use of the rotary boring head for tube-lined pile foundations, each pivotal wing is provided on its radially outwardly disposed side wall with a return rail which is inclined upwards in the boring direction and which lie within the internal diameter of the bore tube used when the pivotal wings are in the inwardly swung rest position.

The invention defined above is based on the problem to render applicable to tube-lined pile foundations the known rotary boring head designed for horizontal boring operations, in order to ensure that the pivotal wings swing back with certainty to their rest position within the internal diameter of the bore tubes, when the rotary boring head is to be pulled up after a working operation. The reversal of the direction of rotation of the boring head is insufficient in vertical boring operations, and there exists the risk that the pivotal wings are still swung outwards and impinge on the lower end face of the lowest bore tube, when the rotary boring head is pulled upwards, whereby the entire boring apparatus would be blocked.

The inclined return rails according to the invention, at the swing wings avoid this danger in a simple and progressive manner, in that upon reversal of the direction of rotation of the boring head as well as upon upward travel of the latter, these return ledges are subjected to an inwardly directed return impulse by the mass of earth pressing on the wedge-shaped return rails and the pivotal wings are swung inwards thereby with certainty until they are again within the internal diameter of the bore tubes. So-to-speak the mass of earth as well as the inclined return rails together form a wedge thrust drive. If, when approaching the lower end face of the lowest bore tube, the pivotal wings are not completely swung back yet, this end face completes the return movement, in that it abuts against the wedge-shaped return rails.

In order to integrate the rotary boring head according to the invention with a helical borer for removing the loosened earth or rock mass, in the case of vertical boring operations in conjunction with tube-lined pile foundations, a further development of the rotary boring head a further development of the rotary boring head consists in that the double-wing-shaped chisel support is attached to a double-wing-shaped base plate of a helical borer the last two double-threaded screw surfaces of which extend each into an inclined receiving blade of each chisel support wing.

In a further development the pivotal wings are pivotally mounted on the base plate below the screw threads starting from the base plate and the wedge-shaped spaces between the screw threads and the base plate in the region of the pivot bearings of the pivotal wings are protected against the ingress of earth masses or lumps of rock by wedge-shaped sheet metal walls which extend axially and in a circular arc. This embodiment is to maintain the pivot bearings for the pivotal wings in an easily movable condition, in that the pivot bearings are protected against the ingress of earth or rock lumps by covering plate walls.

Preferably, the double-wing-shaped chisel support is releasably and interchangeably connected to the base plate attached to the helical borer shaft by two pins which extend through the base plate and which transmit the torque. Thereby a releasable and interchangeable arrangement of the chisel support on its base plate is obtained. It is attained thereby that depending upon the soil conditions a boring head suitable for these conditions may be employed.

Figure 7:
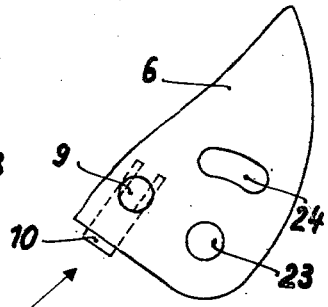
Figures 4, 5:
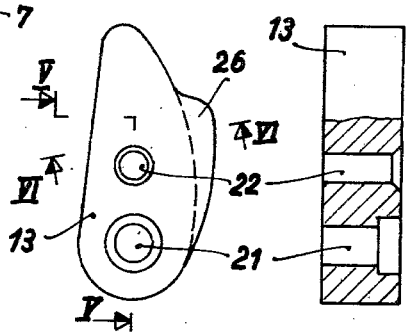
Figure 2:
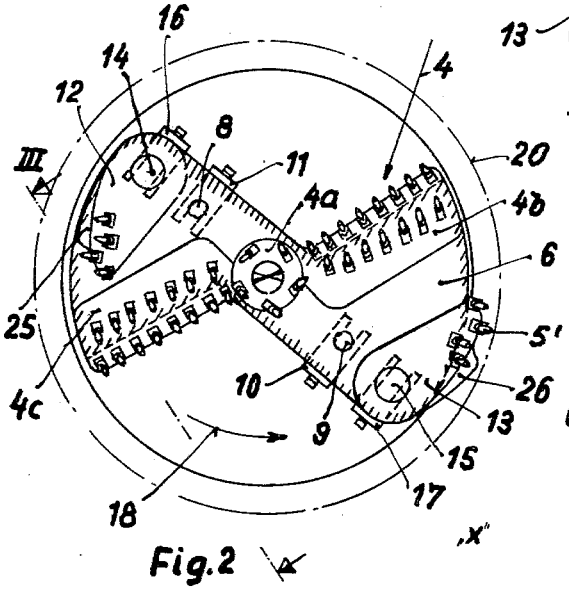
Figure 6:
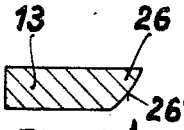

A constructional example of a rotary boring head according to the invention in combination with a helical borer is illustrated in the drawing. There are shown in:

FIG. 1 a side view with axial section through the last bore tube,

FIG. 2 a view from below in the direction of arrow "X" in FIG. 1 of the rotary boring head, FIG. 3 a section on the line III—III in FIG. 2, FIG. 4 a separate pivotal wing without round shank chisel, in a view from above, FIG. 5 a section on the line V—V in FIG. 4, FIG. 6 a section on the line VI—VI in FIG. 4, and FIG. 7 a portion of the base plate in the region of the holder of a pivotal wing.

The illustration of FIG. 1 shows the last windings of a helical borer with the driving shaft 1 and the screw thread 2 which in its last turn is of double-thread construction by the insertion of half a second screw thread 2*a*. The helical borer with the rotary boring head located at the lower end is illustrated as being in the working position, this being indicated by the last bore tube 3.

The rotary boring head comprises first a double-wing-shaped chisel support 4 (FIG. 2) with a central mandrel 4*a* and the two wings 4*b* and 4*c*, all of which are fitted with round shaft chisels 5 in a known manner. The chisel support 4 is fixed from below on a base plate 6 which is non-rotatably connected to the worm shaft 1 in a manner not illustrated in detail and which likewise has a double-wing-shaped configuration which is indicated in FIG. 2 by hatching starting from the outline.

Figure 3:
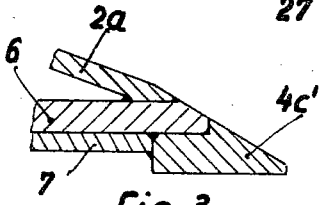

As is illustrated in FIG. 3 for the one wing 4c of the chisel support, the screw surface 2a associated therewith is welded at the end to the base plate 6 and continues as an inclined receiving blade 4c' of this chisel support wing. Likewise the helical surface 2 continues by its last turn as an inclined receiving blade of the wing 4b by way of the base plate 6. The receiving blade 4c' illustrated in FIG. 3 without round shaft chisel is unitary with a support plate 7 which is associated with the chisel support 4 and which underlies the base plate 6, nearly coinciding with the double-wing-shaped configuration thereof. Thus the chisel support 4 with the support plate 7 is constructed as a component which is releasable from the base plate 6 and is interchangeably connected to the base plate 6 by means of two bolts 8, 9 which extend through the base plate 6 and which transmit the torque. FIG. 7 illustrates a portion of the base plate 6 in the region of the bolt 9 which is pushed from below through the support plate 7 as well as the base plate 6 and is secured by a fork-like latch 10 which engages into a groove-like recess of the bolt 9. The bolt 8 is secured by a fork-like latch 11 in the same manner. Since the base plate 6 is non-rotatably connected to the rotary shaft 1, the two bolts 8 and 9 transmit the torque to the double-wing-shaped chisel support 4.

The regions not occupied by the wings 4b and 4c of the chisel support 4, of the double-wing-like base plate 6 support diametrically arranged pivotal wings 12, 13 which are pivotally mounted on shafts 14 and 15 parallel to the axis of rotation of the chisel support 4. Fork-shaped latches 16, 17 serve likewise for securing the position of these pivotal wings 12, 13, so that the pivotal wings 12, 13 are also mounted in a releasable and interchangeable manner.

The pivotal wings 12, 13 likewise fitted with round shaft chisels extend from their pivot axes 14, 15 in the direction of rotation of the rotary boring head which is indicated by the arrow 18. Because of the resistance which is encountered by the round shaft chisels at the earth mass or the rock formation upon rotation of the rotary boring head, the rotary wings 12, 13 swing outwards and have thereby a free-cutting effect in relation to the chisel support 4. In FIG. 2, merely the pivotal wing 13 is swung outwards, so that its outermost round shaft chisel 5' describes a bore circle 20. The pivotal wing 12 is illustrated in the rearward position.

Both the outward position of the pivotal wing 13 as also the rearward position of the pivotal wing 12 are limited by abutments. FIG. 4 in conjunction with FIG. 5 shows that for example the pivotal wing 13 comprises a bore 21 for receiving the pivot shaft 15 which also extends through a bore 23 in the base plate 6 (and obviously also in the support plate 7), and additionally an eccentric bore 22 through which an abutment pin may be inserted which engages into an arc-shaped slot 24 of the base plate 6. The displacement path of this abutment pin not illustrated within the arc-shaped slot 24 determines the pivoting range of the pivotal wing 13.

Wedge-shaped return rails 25, 26 are formed on the radially outwardly disposed side faces at the pivotal wings 12, 13; they are located within the outermost bore circle 20 and therefore do not interfere during boring itself. The return rail 26 clear from the section according to FIG. 6 has a side face 26' which rises radially in the boring direction 27. In conjunction with FIG. 6 the boring direction 27 is directed upwards for the reason that the pivotal wing 13 illustrated in FIG. 4 is shown in the view from below, i.e. in the direction of arrow "X" according to FIG. 1. Therefore, in the case of the pivotal wing 12 in FIG. 1, the inclined side wall 25' thereof extends in the opposite direction. These inclined side walls 25' and 26', or the respective return rails 25, 26 forming them, have the effect that upon withdrawal of the helical borer shaft 1 and the rotary boring head attached thereto the loosened earth mass or rocks exert a pressure on the surfaces 25' and 26' with the consequence that radially inwardly directed force components are produced as return impulses for the pivotal wings 12 and 13. It is ensured thereby, and the limitation of the pivotal position for the pivotal wings is also designed correspondingly, that upon upward withdrawal of the boring apparatus the pivotal wings swing back with certainty as far as inside the internal diameter of the bore tube 3, as is illustrated in FIG. 2 for the pivotal wing 12.

Returning to FIG. 1, it must be said that the pivotal wings 12, 13 are mounted by their pivot pins 14, 15 below the screw threads 2 and 2a starting from the base plate 6, that is to say in wedge-shaped spaces which could be closed easily by earth masses and loosened pieces of rock. In order to maintain the pivot bearings for the pivotal wings in an easily movable state, these wedge-shaped spaces between the screw threads and the base plate in the region of the pivot bearings of the pivotal wings are protected against the ingress of earth masses or lumps of rock by wedge-shaped plate walls 29 and 30 extending axially and in a circular arc. In FIG. 1 the view is upon the outer surface of the sheet metal wall 29, whereas the sheet metal wall 30 is visible in a view upon the inwardly directed surface.

The manner of working of the twin-bladed rock bore worm illustrated with the pivotal wings 12 and 13 serving for free cutting is as follows:

For continuing a bore, the worm 1, 2 with the rotary boring head attached to the base plate 6 is lowered into a sunken bore tube 3, the pivotal wings 12 and 13 being swung inwards. When, after impinging upon the earth mass or a rock formation, boring is to be started, the worm shaft 1 is driven in the direction of rotation 18, whereby the free-cutting pivotal wings 12 and 13 work their way outwardly, as is illustrated for the pivotal wing 13. When the screw thread 2 is filled sufficiently with loosened material, the boring apparatus must be pulled upwards, in order to discharge the material. For this purpose the direction of rotation 18 is first reversed, whereby the pivotal wings 12 and 13 have the tendency to return to their inwardly swung position. This is assisted during upward withdrawal of the boring apparatus, by the inclined radial side walls 25' and 26' of the pivotal wings in the manner described, so that they cannot abut against the lower end face of the bore tube 3. If nevertheless they were to abut there, then by means of the inclined wedge faces 25', 26', which may have the effect that the pivotal wings are moved back completely to within the internal diameter of the bore tube 3.

What is claimed is:

1. A rotary boring head for boring holes in earth and rock formations and for use in connection with one or more bore tubes each having an end face, the rotary boring head comprising:

a helical screw;

a base plate at one end of said helical screw and disposed therebelow;

said helical screw and said base plate together partially defining a generally wedge-shaped space therebetween;

a rotatable chisel support coupled with said base plate;

a plurality of chisels on said support;

a pivotal wing mounted on said chisel support by a pivot shaft disposed parallel to the axis of rotation of said chisel support;

a plurality of chisels on said pivotal wing, said chisels on said wing being capable of cutting freely when said pivotal wing is swung into a radially outward working position in relation to said chisel support;

an abutment for limiting movement of said pivotal wing;

said pivotal wing being swingable into an inner rest position upon reversal of the direction of rotation of the boring head, which reversal takes place when the boring head is to be withdrawn from the bore hole;

said pivotal wing including on a radially outwardly disposed side wall thereof a return rail portion which is inclined upwardly in the boring direction for assisting swing back of said pivotal wing by impingement of said return portion on loosened earth or rock and/or the end face of the lowermost bore tube during withdrawal of the rotary boring head out of the bore hole; and a generally wedge-shaped wall covering said generally wedge-shaped space in the region of said pivot shaft which mounts said pivot wing, said wall sealing against the ingress of earth masses and lumps of rock into said generally wedge-shaped space, said wall extending axially and in a circular arc.

2. A rotary boring head according to claim 1 wherein the double-wing-shaped chisel support is releasably and interchangeably connected to the base plate by two pins which extend through the base plate and which transmit the torque.

3. A rotary boring head according to claim 2 including a pair of said pivotal wings, said pivotal wings being disposed diametrically opposite each other, said helical screw comprising double helixes at least at a lower portion thereof, said chisels being round shaft chisels, said base plate and chisel support having double wing shapes, said double helixes extending into inclined receiving blades of said double wing chisel support, each wing of said base plate and one helix of said double helixes partially defining one said generally wedge-shaped space therebetween so that a pair of wedge-shaped spaces are defined, each space of said pair being covered by one said generally wedge-shaped wall, each said wall being of sheet metal.

* * * * *